United States Patent [19]

Hugens

[11] 4,258,519

[45] Mar. 31, 1981

[54] MEANS FOR JOINING PANELS

[76] Inventor: Andrew Hugens, 1 Avenues Ct. Victoria Ave., Hull, England

[21] Appl. No.: 22,037

[22] Filed: Mar. 19, 1979

[51] Int. Cl.[3] ..... E04B 1/38

[52] U.S. Cl. ..... 52/282; 52/738

[58] Field of Search ..... 52/282, 280, 281, 288, 52/775, 738, 731, 393, 395

[56] References Cited

U.S. PATENT DOCUMENTS

| | | | |
|---|---|---|---|
| 2,638,191 | 5/1953 | Menosky | 52/775 |
| 2,945,269 | 7/1960 | Domen | 52/775 X |
| 3,196,992 | 7/1965 | Owen | 52/282 |
| 3,342,001 | 9/1967 | Arnd | 52/775 |
| 3,528,692 | 9/1970 | De Vries | 52/775 X |
| 3,603,054 | 9/1971 | Didry | 52/282 |
| 3,866,381 | 2/1975 | Eschbach et al. | 52/282 |
| 3,989,397 | 11/1976 | Baker | 52/288 |
| 4,040,219 | 8/1977 | Budich | 52/775 |
| 4,132,044 | 1/1979 | Rollyson | 52/775 |

*Primary Examiner*—J. Karl Bell

*Attorney, Agent, or Firm*—Fred Philpitt

[57] ABSTRACT

The present invention describes and claims a device for joining panels comprising first and second panel receiving means. An extrusion moulded member forming part of said first and second panel receiving means having a flange, in use, engaging around an edge of a panel and having a first groove, one edge of which is inwardly turned to constitute a lip. An extrusion moulded gripping member having a groove which receives said lip. One edge of said gripping member being arranged to abut against the inside of the first groove. A second edge of said gripping member remote from said first edge being arranged, in use, to engage the panel whereby the panel is resiliently gripped between said second edge and said flange, a second panel being retained by said second panel receiving means.

17 Claims, 5 Drawing Figures

MEANS FOR JOINING PANELS

The invention relates to a device for joining panels.

Hitherto panels in caravans, boats, argricultural buildings, vehicle buildings and modular building applications have been joined together by the use of screws, rivets and other unsightly methods. Furthermore, the effort involved and time consumed in fixing panels in this way is disadvantageous and costly. It is an object, therefore, of this invention to provide a device for joining panels which solves at least some of the above-mentioned problems.

In accordance with this invention there is provided a device comprising a first means for gripping a panel or the like which comprises an extrusion moulded section which, on the one hand, has a flange which is engageable around an edge of the panel and, on the other hand, is provided with a first longitudinal groove whose edge remote from the flange is inwardly turned and constitutes a lip which is directed towards the inside of the groove, and an extrusion moulded spring section which has a second longitudinal groove, which is adapted to receive the lip of the first longitudinal groove, a first edge, contiguous to its groove, which is adapted to abut against the inside of the first longitudinal groove, and a second edge, also contiguous to its groove but remote from its first edge, which is adapted in use to abut against a panel or the like, which panel or the like is thereby resiliently gripped between the flange and the second edge, and a second means for gripping a second panel, the first and second means being incorporated on the same device.

By virtue of this construction, and with the additional use of adhesives, mastics or gaskets as desired, panels may be fixed to one another in a simple, effective and relatively inexpensive manner.

The invention is further described herinafter, by way of example only, with reference to the drawings accompanying the Provisional Specification, in which.

Figure 2:
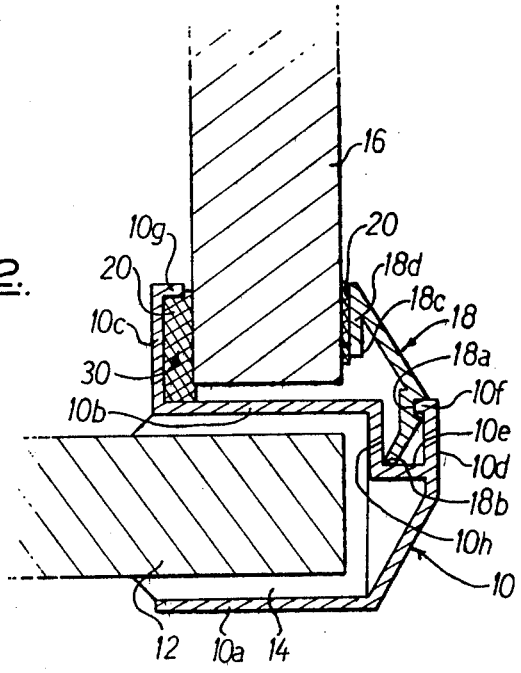
FIG. 2 is a vertical section through the same embodiment as illustrated in FIG. 1 in which a wall panel is shown to be perpendicularly fixed to a floor panel.
Figure 5:
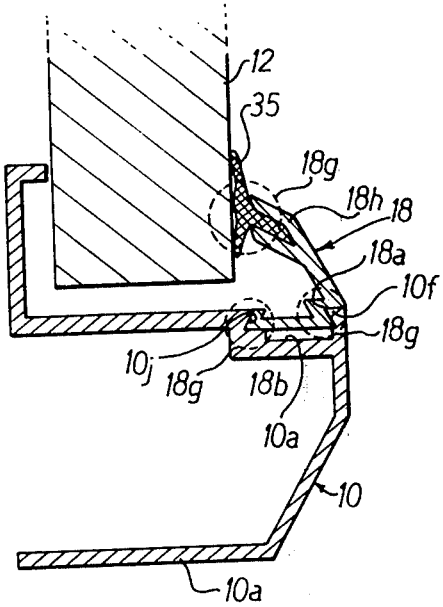

and in the accompanying drawing referenced FIG. 5, which is a vertical section similar to that of FIG. 2 through a further embodiment of the present invention.

Figure 1:
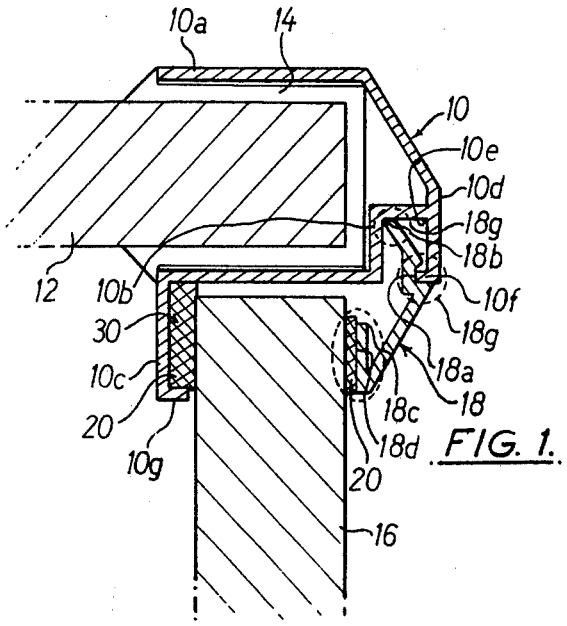
FIG. 1 is a vertical section through one embodiment of this invention which is shown fixing a wall panel to a roof panel at right angles to one another.

In FIGS. 1 and 2 a generally U-shaped section 10 is fitted along the lengths of the panels 12. This section, which is extrusion moulded, is fixed to the panel with adhesive or by means of a gasket 14. Of the arms 10*a*, 10*b* of the section 10, one arm 10*a* lies parallel with the panel 12, separated from it by the gasket or adhesive, while the other arm 10*b*, which also lies parallel to the panel for a length substantially equal to that of 10*a*, has a longitudinal flange 10*c* which extends away from the panel 12 and serves to support a second panel 16, to which the panel 12 is to be fixed. At the end of the flange 10*c* there is an inwardly turned spigot 10*g* which is preferably substantially perpendicular to the flange 10*c*. The function of the spigot is discussed in detail below. In the drawings the longitudinal flanges 10*c* are substantially perpendicular to the panels 12. However, this is not a necessary feature of this invention and in other embodiments it is preferable if the panel 26 is at some other angle to the panel 12, in which case the flange 10*c* is angled to arm 10*b* so that it is in substantially parallel alignment with panel 16 as is the case in FIGS. 1 or 2.

The base 10*d* of section 10 is constructed to form a generally U-shaped longitudinal groove 10*e* which opens in a direction which is substantially the same as that of the flange 10*c*. The groove 10*e* has two sides, the side 10*h* forming part of the arm 10*b* of the section 10 while the other is an extended flange of the base 10*d* and is provided with a lip 10*f* which is turned towards the mouth of the groove 10*e*.

A second section 18 is provided which is constructed and adapted, also by extrusion moulding, to be received within the longitudinal groove 10*e* and to grip the panel 16 between itself and the flange 10*c*. This section 18 is spring fitted into the groove and has a small groove 18*a* which receives the lip 10*f* of the groove 10*e*. It also has an edge 18*b* which is adapted to abut the side wall 10*h* of the groove 10*e* when the lip 10*f* is received within the small groove 18*a*. The other edge 18*c* of the spring section 18 is folded inwards so as to provide a flat surface 18*d* for abutment with the panel 16. As a result of the spring section 18 exerting a force in the pressure area 18*g*, and because the spring section is being permanently compressed, the panel 16 is resiliently gripped between the flange 10*c* and section 18 with consistant and accurate pressure. A mastic or gasket 20 may be provided between the flange 10*c* and the panel 16, and/or between the panel and the spring section 18, so as to afford even better grip on the panel and also so as to seal the gap therebetween. In this way it is possible to join two panels in a simple and efficient manner. The embodiments illustrated are adapted for fixing a wall to a floor or for fixing a ceiling to a wall in a typical building situation. Normally a corner post 22 illustrated in FIG. 3 would be used to fix a wall to a second wall but in either case the embodiments' uses are not restricted solely to their uses as illustrated in the drawings.

Figure 3:
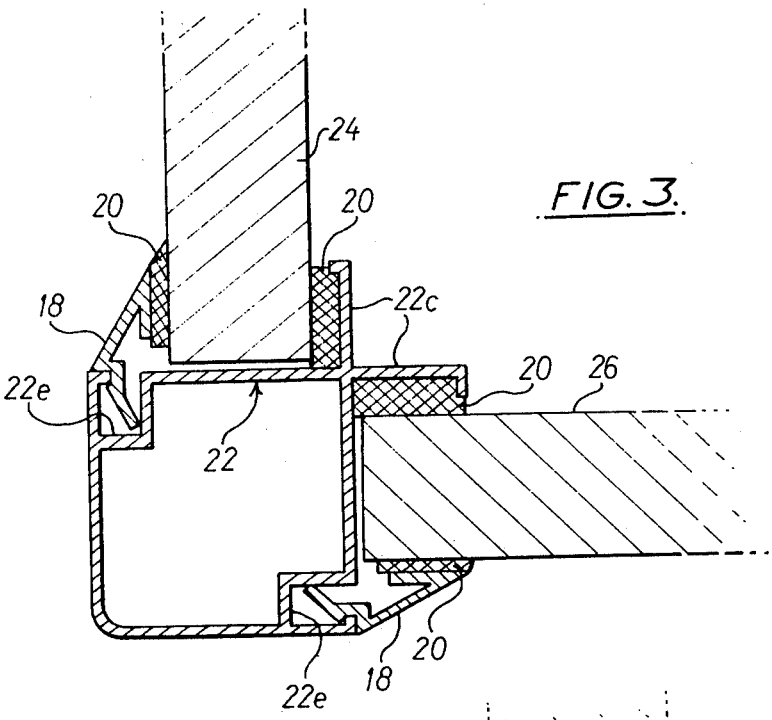
FIG. 3 is a horizontal section through two panels which are fixed perpendicularly to one another by a second embodiment of this invention.

The embodiment illustrated in FIG. 3 includes a box section 22 which is adapted to fit in the corner between two panels 24, 26 and is provided in the place of, and which differs from, the section 10 of the first embodiment illustrated in FIGS. 1 and 2. In this embodiment two spring sections 18, two flanges 22*c* and two longitudinal grooves 22*e* are provided which are equivalent, and have substantially the same function as those of the first embodiment indicated by the reference numerals 18, 10*c* and 10*e* respectively.

Similarly to the first embodiment, a panel 26 is resiliently gripped and held between the flange 22*c* and the spring section 18, mastic or a gasket 20 separating the latter members from the panel. A similar arrangement allows the panel 24 to be fixed with respect to the panel 26, and at a predetermined angle to it, which is, in this embodiment, a right angle.

Figure 4:
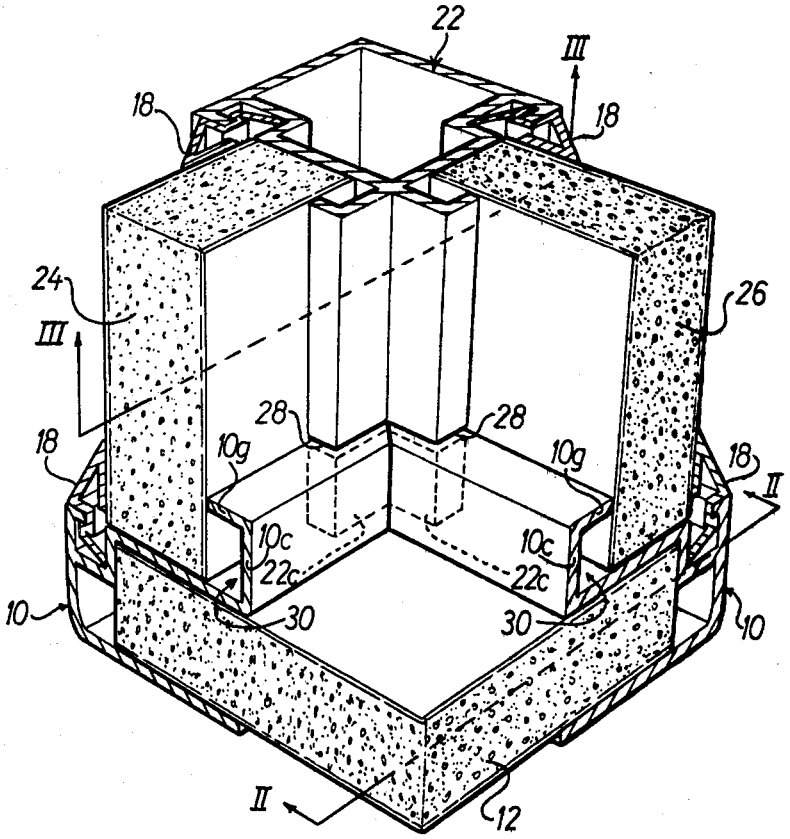
FIG. 4 is a fragmentary perspective view of an assembly in which the embodiments of FIGS. 1 and 2 and FIG. 3 are shown illustrating the mutural interlocking arrangment of the panels.

FIG. 4 illustrates a typical situation in which three panels 12, 24 and 26 are fixed at mutual right angles to one another by two sections 10 and a box section 22. This Figure makes clear the necessity for the spigots 10*g* on the arms 10*c* of the sections 10. The spigots 10*g* abut the panels 24,26 and keep the arms 10*c* away from the panels. Thus there is a gap 30 provided which is large enough to receive the arms 22*c* of the box section 22 in the corner region where the three sections meet. To allow the continued functioning of the spigots 10*g*, grooves 28 are cut in the arms 22*c*. These grooves then accommodate the spigots 10*g* so that the three panels are firmly held in their relative juxtaposition which, in the case illustrated in FIG. 4, is substantially a mutually perpendicular arrangement. Nevertheless, although this facility is an important feature of the invention, its scope is not restricted to perpendicular arrangement of the panels, since it is possible that other arrangements may occasionally be employed in which the angles between panels are not right angles. In these cases appropriate mitring of the ends of the sections 10,22, shaping of the various flanges 10*c*, 22*c* and longitudinal grooves 10*e*, 22*e* and cutting of the grooves 28 allows these different angles to be attained.

Finally, an added advantage of this method of joining panels is that it is extremely easy to waterproof the joints. The orientation of the sections as indicated in the drawings lends itself to efficient sealing, particularly with the aid of mastics or adhesive. Furthermore, the groove 10*e*, with the orientation as indicated in FIG. 2, acts as a gutter so as to drain water away.

In the embodiment illustrated in FIG. 5 like parts have been given the same reference numerals and which parts accomplish the same functions as in the previous embodiment. However, in this embodiment the spring section 18 has a different shape whereby not only does it hold the panel 12 in place but it is also rendered more difficult to remove and hence more resistant to tampering.

This is because the edge of the spring section not only presses against the side of the longitudinal groove 10*a* but also engages with a preferably correspondingly shaped recess 10*j* whereby the spring section is held in place to greater effect than in the earlier embodiments.

The flat 18*d* of the previous embodiments has also been changed in that the spring section is provided with a forked portion 18*h* for receiving a flange of a rubber-like gasket which is preferably constructed from neoprene and which provides greater flexibility to the system than in the first embodiments, and takes over the function of the flat 18*d*.

What I claim is:

1. An assembly for joining panels comprising at least two gripping arrangements, each gripping arrangement having first and second panel receiving means and being formed in part by an elongate extruded member, at least one of said panel receiving means being defined between a flange of said elongate extruded member and an elongate gripping member which is adapted to be received and retained in a first longitudinal groove in said elongate extruded member, a flange of one gripping arrangement having a slot which receives a portion of the flange of at least one other gripping arrangement whereby said gripping arrangements are interengageable at predetermined angles relative to one another.

2. An assembly according to claim 1 wherein the flange of the at least one other gripping arrangement carries at its free end an inturned lip, directed in use toward the panel, which lip is received in said slot.

3. An assembly according to claim 1 wherein the flange of each gripping arrangement carries at its free end an inturned lip directed, in use, toward the panel, and wherein the flange having the slit is disposed, in use, between the panel and the flange of said at least one other gripping arrangement.

4. An assembly according to claim 1 wherein the extruded gripping member is resilient.

5. An assembly according to claim 1 wherein said first and second panel receiving means of each gripping arrangement are disposed so as to retain adjacent panels substantially perpendicular with respect to one another.

6. An assembly according to claim 1 wherein the first longitudinal groove of said one gripping arrangement has an edge remote from said flange, which is inwardly turned to constitute a lip, and said elongate gripping member has a second longitudinal groove which is adapted to receive the said lip, a first edge of said elongate gripping member being arranged to abut against the inside of the first longitudinal groove, and a second edge of said elongate gripping member, remove from said first edge, being arranged to, in use, engage the panel whereby the panel is resiliently gripped between said second edge and said flange, a second panel being retained by said second panel receiving means of the said one gripping arrangement which second panel receiving means comprises a second flange of said elongate extruded member, in use engaging around an edge of a second panel, and a third longitudinal groove of said elongate extruded member having an edge remote from said second flange, which is inwardly turned to constitute a lip, a second elongate gripping member also forming part of said second panel receiving means, a fourth longitudinal groove provided in said elongate gripping member being adapted to receive the lip of said third longitudinal groove, a first edge of said second elongate gripping member being arranged to abut against the inside of the third longitudinal groove, and a second edge of said second elongate gripping member, remote from said first edge, being arranged to, in use, engage the second panel whereby the panel is resiliently gripped between said second edge of said second gripping member and said second flange.

7. An assembly according to claim 6 wherein said second flange has a lot which receives a portion of the flange of the said at least one other gripping arrangement.

8. An assembly according to claim 7 wherein the respective slot in said flange and said second flange receives a portion of the flange of respective second and third gripping arrangements.

9. An assembly according to claim 8 wherein the respective slot in the said one gripping arrangement is disposed perpendicular to the longitudinal axis of the said one gripping arrangement.

10. An assembly according to claim 1 in combination with at least one panel wherein a resilient gasket is interposed between said panel receiving means and said panel.

11. An assembly according to claim 1 in combination with at least one panel wherein an adhesive is interposed between the device and said panel.

12. An assembly according to claim 1 wherein the first longitudinal groove of the at least one other gripping arrangement has an edge remote from said flange, which is inwardly turned to constitute a lip, a elongate gripping member also forming part of said first panel receiving means and said elongate gripping member has a second longitudinal groove which is adapted to receive the said lip, a first edge of said elongate gripping member being arranged to abut against the inside of the first longitudinal groove, and a second edge of said elongate gripping member, remote from said first edge, being arranged to, in use, engage the panel whereby the panel is resiliently gripped between said second edge and said flange, said second panel receiving means comprising a substantially U-shaped section for retaining a second panel.

13. An assembly according to claim 12 wherein one arm of said substantially U-shaped section is formed by a connection between said flange and said first longitudinal groove and in which at least a part of the base of said substantially U-shaped section is formed by said first longitudinal groove.

14. An assembly according to claim 12 or 13 wherein the second edge of said elongate gripping member has a flat surface for abutment with said panel.

15. An assembly according to claim 1 wherein the first longitudinal groove of said gripping arrangement has an edge remote from said flange, which is inwardly turned to constitute a lip, a longitudinal recess of said first longitudinal groove of said elongate extruded member remote from said lip, a second longitudinal groove provided in said elongate gripping member which second longitudinal groove is adapted to receive the lip of said first longitudinal groove, a first edge of said elongate gripping member being adapted to engage in said longitudinal recess of said elongated extruded member and a second edge of said elongate gripping member, remote from said first edge, being arranged to, in use, engage the panel whereby the panel is resiliently gripped between said second edge and said flange, a second panel being retained by said second panel receiving means.

16. An assembly according to claim 15 wherein the elongate gripping member is adapted to mount a resilient gasket for abutment with the panel.

17. An assembly according to claim 15 or 16 wherein the elongate gripping member is provided with a forked mouth on said second edge for receiving a flange of the resilient gasket.

* * * * *